United States Patent [19]

de Boer et al.

[11] 4,050,151

[45] Sept. 27, 1977

[54] DRY-SHAVING APPARATUS

[75] Inventors: Jan de Boer; Jan Reinink, both of Drachten, Netherlands

[73] Assignee: U.S. Philips Corporation, New York, N.Y.

[21] Appl. No.: 669,324

[22] Filed: Mar. 22, 1976

[30] Foreign Application Priority Data

Apr. 11, 1975 Netherlands ..... 7504322

[51] Int. Cl.[2] ..... B26B 19/10

[52] U.S. Cl. ..... 30/34.1

[58] Field of Search ..... 30/34.1, 43.92

[56] References Cited

U.S. PATENT DOCUMENTS

| | | | |
|---|---|---|---|
| 3,440,724 | 4/1969 | Wich | 30/34.1 |
| 3,889,371 | 6/1975 | Boer | 30/34.1 |

*Primary Examiner*—Gary L. Smith

*Attorney, Agent, or Firm*—Frank R. Trifari; Rolf E. Schneider

[57] ABSTRACT

In a dry-shaving apparatus having an electric motor switch and an element for coupling a trimmer to the motor, there is provided an arrangement for coupling the motor switch to the coupling element for the trimmer so that when the motor is switched off, the trimmer is automatically disengaged.

3 Claims, 5 Drawing Figures

DRY-SHAVING APPARATUS

This invention relates to a dry-shaving apparatus with a cutter for shaving off short hairs, which is drivable by an electric motor, and a separate trimmer for long hairs, with a motor switch provided with an actuating member which is movable between an on position and an off position, whilst the trimmer can be coupled to the motor by means of a movable coupling element, which is provided with a separate actuating member.

Such a shaving apparatus is for example known from U.S. Pat. No. 3,889,371. In practice it often happens that switching the trimmer off after use is omitted. If subsequently the cutter for short hairs is used the trimmer is also driven, which presents an unnecessary load to the motor.

It is an object of the invention to provide a shaving apparatus in which the situation outlined above cannot occur and which is characterized in that the actuating member for the motor switch cooperates with the coupling elements of the trimmer, so that the off-position of the actuating member for the motor switch corresponds, to the disengaged position of the trimmer.

A preferred embodiment is characterized in that the actuating member for the motor switch is coupled to the coupling element of the trimmer with the aid of mechanical means, which comprise a carrier arm which is active in one direction.

A further embodiment is characterized in that the movable coupling element of the trimmer is movable under the influence of an electromagnet, the motor switch being included in the electrical circuit of the electromagnet.

The invention will be described in more detail with reference to the embodiment shown in the accompanying drawings, in which:

FIG. 4 shows a part of an interior view of a housing half of FIG. 1, both the motor and the trimmer being switched on.

Figure 1:
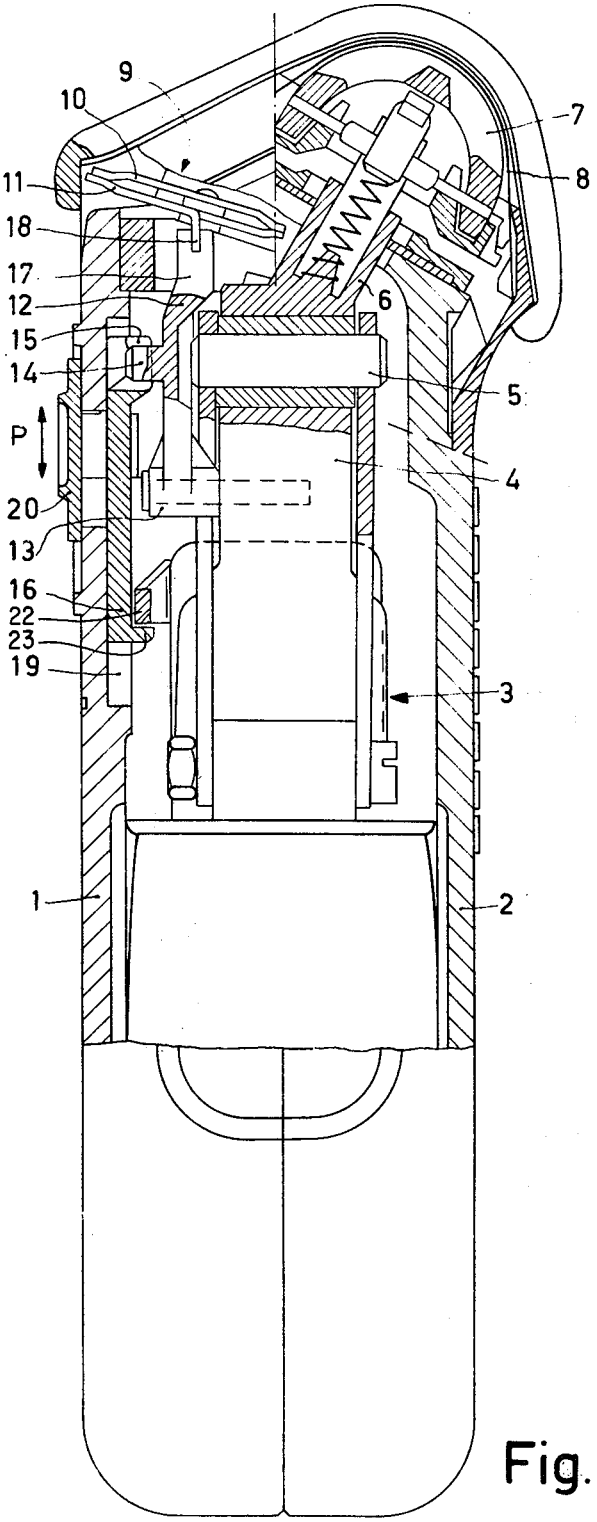
FIG. 1 is a side view, partly in cross-section, of a vibrator dry shaving apparatus.

As is shown in FIG. 1 the housing of the shaving apparatus substantially comprises two housing halves 1 and 2 between which the vibrator motor 3 is accommodated. The armature 4, which oscillates about the spindle 5 drives the reciprocating cutter 7 with the drive arm 6. This cutter cooperates with the foil 8 in which apertures are formed and serves in particular for shaving off short hairs such as beard stubble. In addition, the apparatus includes a trimmer 9 for longer hairs. This trimmer substantially comprises a stationary cutter 10 and a reciprocatory cutter 11. The movable cutter 11 is also driven by the motor 3 and is coupled thereto by means of the drive lever 12.

At one end 13 the drive lever 12 is rotatably mounted on the armature 4. Drive lever 12 is also provided with the stub 14 which in the position shown in FIG. 1 and FIG. 4 engages the slot 15 at the top of the coupling element 16. The other end 17 of the drive lever 12 is coupled to the movable cutter 11 by means of the tab 18. The coupling element 16 is accommodated in the seat 19 on the inside of the housing half 1 and is movable in vertical directions as indicated by the arrows P. The coupling element 16 is provided with an actuating member 20 which is situated at the outside of the apparatus.

Figure 2:
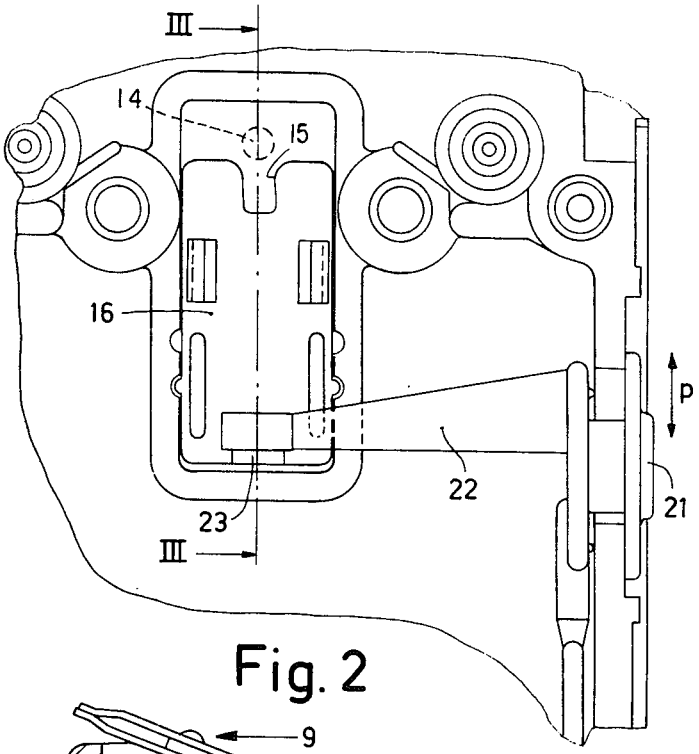
FIG. 2 shows a part of an interior view of one housing half of FIG. 1, both the motor and the trimmer being switched off.
Figure 4:
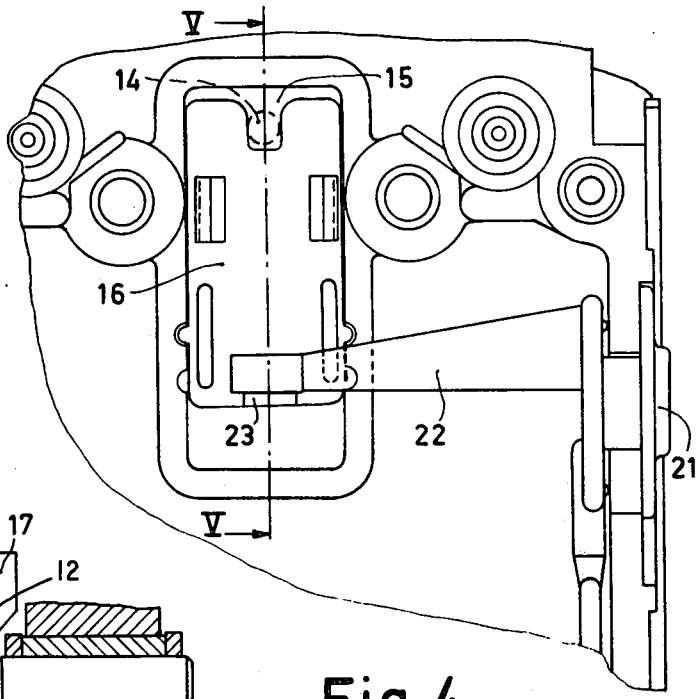

The shaving apparatus is also provided with a switch for the motor, which is actuated by an actuating member 21, which is also movable in vertical directions as indicated by the arrow between an "off" position and an "on" position as shown in FIG. 2 and FIG. 4 respectively. The actuating member 21 is provided with a carrier arm 22, which cooperates with the coupling element 16 by means of a stop 23.

Figure 3:
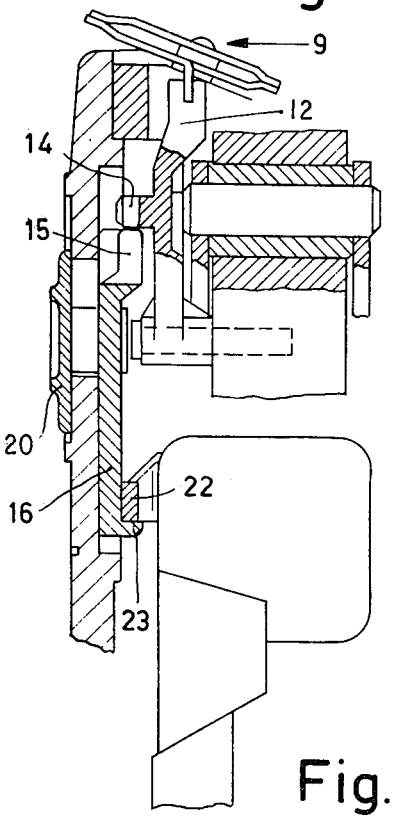
FIG. 3 is a cross-section taken along the line III—III in FIG. 2.
Figure 5:
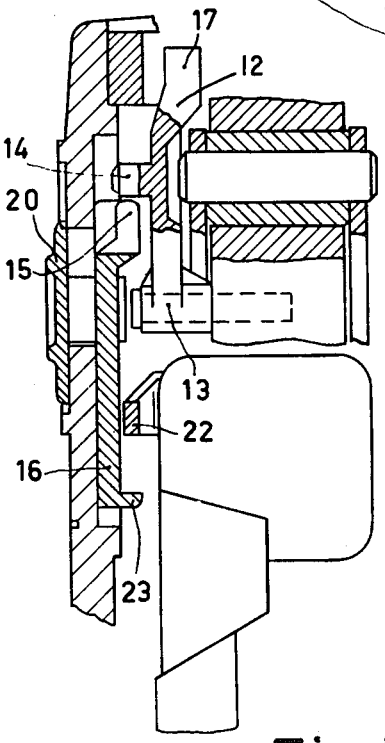
FIG. 5 is a cross-section taken along the line V—V in FIG. 4, the motor being switched on but the trimmer being switched off.

The operation of the apparatus is as follows. From the position as shown in FIGS. 2 and 3, in which both the motor 3 is switched off and the trimmer 9 is disengaged, the motor is switched on by moving the actuating member 21 to the position as shown in FIGS. 4 and 5. The cutter 7 is now driven by the motor. The drive lever 2 is also now driven by the armature 4 but oscillates about the end 17 because the stub 14 is not enclosed in the slot 15. Consequently, the trimmer is not driven (FIG. 5).

When the actuating member 20 is now moved from the position of FIG. 2 to that of FIG. 4, the stub 14 is enclosed in the slot 15 and the drive lever 12 will oscillate about stub 14. The trimmer is now also driven (see FIG. 1 and FIG. 4). By then moving the actuating member 21 from the position of FIG. 4 in a downward direction towards the position of FIG. 2, the motor is switched off. The end of the carrier arm 22 thereby simultaneously co-operates with the stop 23 on the coupling element 16, with the result that the coupling element 16 is taken along, and the trimmer is automatically disengaged. The carrier arm 22 cooperates with the stop 23 only in the downward direction, the coupling element 16 being moved in the opposite direction during the upward movement of the actuating member 20.

Obviously, it is also possible to provide the coupling element 16 with a carrier arm which cooperates with a stop on for example the actuating member 21.

In lieu of coupling the actuating member 21 for the motor switch and the coupling element 16 for the trimmer by mechanical means, coupling by electromagnetic means is also possible. For example, such actuating member may be adapted to move the coupling element for the trimmer against a spring force into a position in which the electrical circuit of an electromagnet is closed, with the result that the coupling element is retained in this position. This circuit also includes the motor switch, whereby when the motor is switched off the electromagnet no longer exerts a force on the coupling element which is thereby brought into a position in which the trimmer is disengaged by the spring force.

We claim:

1. A dry-shaving apparatus comprising a cutter for shaving off short hairs, an electric motor for driving said cutter, means for actuating said motor and movable between an "off" position and an "on" position, a trimmer for long hairs, a movable element for coupling said trimmer to said motor, means for actuating said movable coupling element between a disengaged position and an engaged position with respect to the trimmer, and means associated with said motor-actuating means and said movable coupling element, said associated means effecting movement of said coupling element into its disengaged position when said motor-actuating means is moved into its "off" position.

2. Apparatus according to claim 1, in which said associated means includes a carrier arm mounted on one of said motor-actuating means and said movable coupling element and a cooperating stop provided on the other of said motor-actuating means and said movable coupling element.

3. Apparatus according to claim 2, in which said carrier arm is mounted on said motor-actuating means and said stop is provided on said movable coupling element.

* * * * *

UNITED STATES PATENT AND TRADEMARK OFFICE

CERTIFICATE OF CORRECTION

PATENT NO. : 4050151

DATED : Sept. 27, 1977

INVENTOR(S) : JAN DE BOER & JAN REININK

It is certified that error appears in the above-identified patent and that said Letters Patent are hereby corrected as shown below:

Column 2, line 10, change "arrow" to --arrows p-- line 20, "2" should be --12--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*